US011058212B2

(12) United States Patent
Feng

(10) Patent No.: US 11,058,212 B2
(45) Date of Patent: Jul. 13, 2021

(54) ELECTRONIC PRODUCT FIXATOR

(71) Applicant: Guangzhou Landscape Communication Equipment Co., Ltd, Guangzhou (CN)

(72) Inventor: Youqing Feng, Anqing (CN)

( * ) Notice: Subject to any disclaimer, the term of this patent is extended or adjusted under 35 U.S.C. 154(b) by 0 days.

(21) Appl. No.: 17/129,959

(22) Filed: Dec. 22, 2020

(65) Prior Publication Data

US 2021/0112957 A1 Apr. 22, 2021

(51) Int. Cl.
*A45F 5/00* (2006.01)

(52) U.S. Cl.
CPC ..... *A45F 5/00* (2013.01); *A45F 2005/006* (2013.01); *A45F 2200/0516* (2013.01)

(58) Field of Classification Search
CPC ..... A45F 2005/006; A45F 2200/0516; A45F 2200/0525; A45F 5/021; F16M 11/041; F16M 13/04; H04M 1/04; Y10T 24/1498
USPC ..... 224/930, 456, 461, 536
See application file for complete search history.

(56) References Cited

U.S. PATENT DOCUMENTS 2,150,709 A * 3/1939 Bake ..... B60N 3/005 281/45
6,105,908 A * 8/2000 Kraus ..... F16L 3/137 24/16 PB
6,349,904 B1 * 2/2002 Polad ..... F16L 3/137 24/16 PB
6,497,393 B1 * 12/2002 Crosslen ..... A47F 7/024 24/16 PB
7,848,512 B2 * 12/2010 Eldracher ..... H04B 1/385 379/450
8,496,144 B2 * 7/2013 Son ..... B62J 99/00 224/276
9,723,116 B2 * 8/2017 Georges ..... A45F 5/00
10,422,466 B2 * 9/2019 Papapanos ..... F16M 13/022
2003/0088948 A1 * 5/2003 Cook ..... F16L 3/2336 24/16 PB

* cited by examiner

*Primary Examiner* — Adam J Waggenspack
(74) *Attorney, Agent, or Firm* — HYIP

(57) ABSTRACT

The present disclosure discloses an electronic product fixator. The electronic product fixator comprises a clip assembly and a locking strap, wherein the clip assembly comprises a first clip connected with one end of the locking strap and a second clip hooping and reciprocating along the locking strap, a top surface of the first clip comprises a first joint, and an end section of the locking strap comprises a second joint wherein a bending part at the end section of the locking strap may connect the first joint and the second joint together so as to fix an electronic device to be fixed between the first and the second joints. The electronic product fixator is advantageous in terms of convenient operation, lightness, compactness, and steady fixation against detachment to prevent an electronic device from damages, by which a user can carry a electronic device by hand holding or wearing.

8 Claims, 6 Drawing Sheets

ELECTRONIC PRODUCT FIXATOR

TECHNICAL FIELD

The present disclosure relates to the technical field of electronic product fixators, in particular to an electronic product fixator for fixing an electronic device.

BACKGROUND

Conventional electronic product fixators for electronic devices are designed for devices of a certain model or specification, which are not universal in many cases and quite limited in use. In addition, as electronic product fixators in the prior art usually cover the screen, the device needs to be detached for use, which is very inconvenient.

Therefore, it is necessary to provide an electronic product fixator that is convenient for use and provides firm fixation.

SUMMARY

The purpose of the present disclosure is to provide an electronic product fixator in order to solve the problems mentioned in the above background art.

In order to achieve the above purpose, the present disclosure provides the following technical scheme:

A electronic product fixator, including a clip assembly and a locking strap, wherein the clip assembly includes a first clip connected with one end of the locking strap and a second clip hooping and reciprocating along the locking strap, a top surface of the first clip includes a first joint, and an end section of the locking strap includes a second joint wherein a bending part at the end section of the locking strap may connect the first joint and the second joint together so as to fix an electronic device to be fixed between the first and the second joints.

Preferably, the first joint is a limiting pin, and the second joint is a limiting hole being capable of matching and connecting the limiting pin.

Preferably, the first clip includes a first clip body and a first slip stopper which is arranged on an inner surface of the first clip body.

Preferably, the second clip includes a second clip body and a second slip stopper which is arranged on an inner surface of the first clip body.

Preferably, the first clip and the second clip have U-shaped vertical sections.

Preferably, the locking strap includes a front section, a middle section and an end section, wherein two ends of the middle section are respectively connected with the front section and the end section, and an inner surface of the middle section has a toothed strap structure.

Preferably, the second clip body includes a locking structure which includes a limiting part arranged in a way fitting in with the toothed strap structure.

Preferably, the second clip body includes a connecting ring that can be connected with a strap.

The electronic product fixator provided by the present disclosure is advantageous in terms of convenient operation, lightness, compactness, and steady fixation against detachment to prevent an electronic device from damages, by which a user can carry the electronic device by hand holding or wearing. In addition, the user may use the device without having to detach it from the electronic product fixator, which is very convenient.

DESCRIPTION OF THE EMBODIMENTS

Technical schemes in the embodiments of the present disclosure will be described clearly and completely with reference to the accompanying drawings thereof. Apparently, the embodiments described herein are only part of, not all of, embodiments in the present disclosure. Based on the embodiments of the present disclosure, all other embodiments obtained by those of ordinary skills in the art without creative work belong to the scope claimed by the present disclosure.

Figure 1:
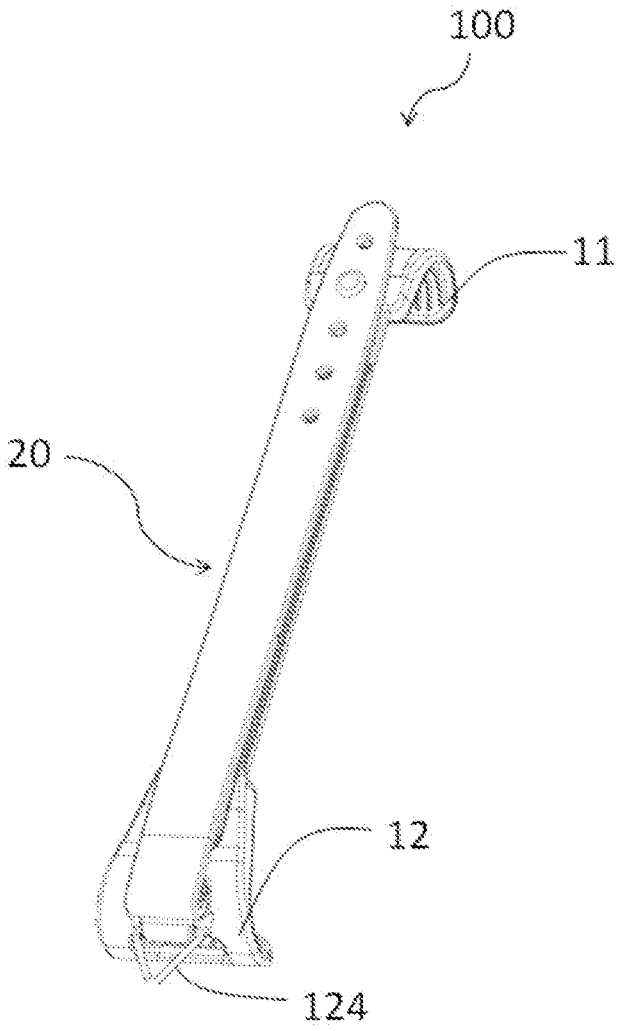
FIG. 1 is a structural schematic diagram of an electronic product fixator in a retraction state according to the present disclosure.
Figure 2:
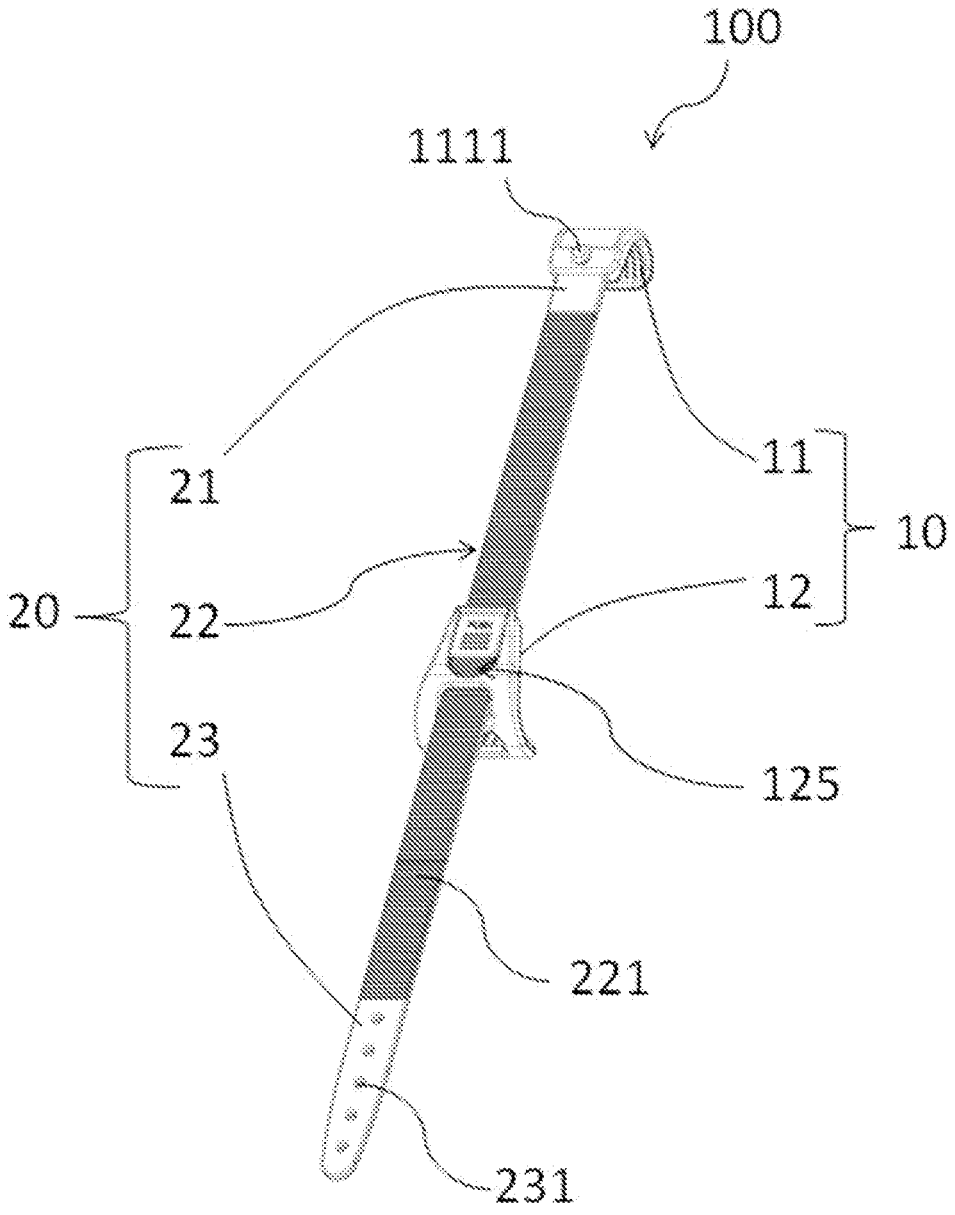
FIG. 2 is a structural schematic diagram of the electronic product fixator shown in FIG. 1 in an opening state.
Figure 3:
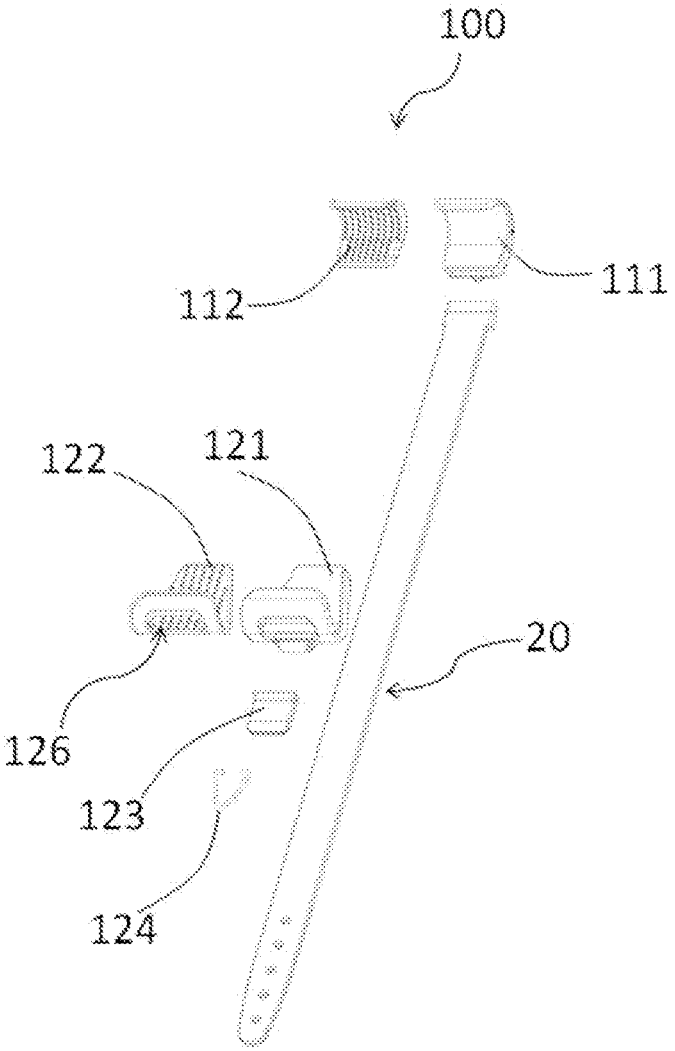
FIG. 3 is an exploded structural schematic diagram of the electronic product fixator shown in FIG. 1.
Figure 4:
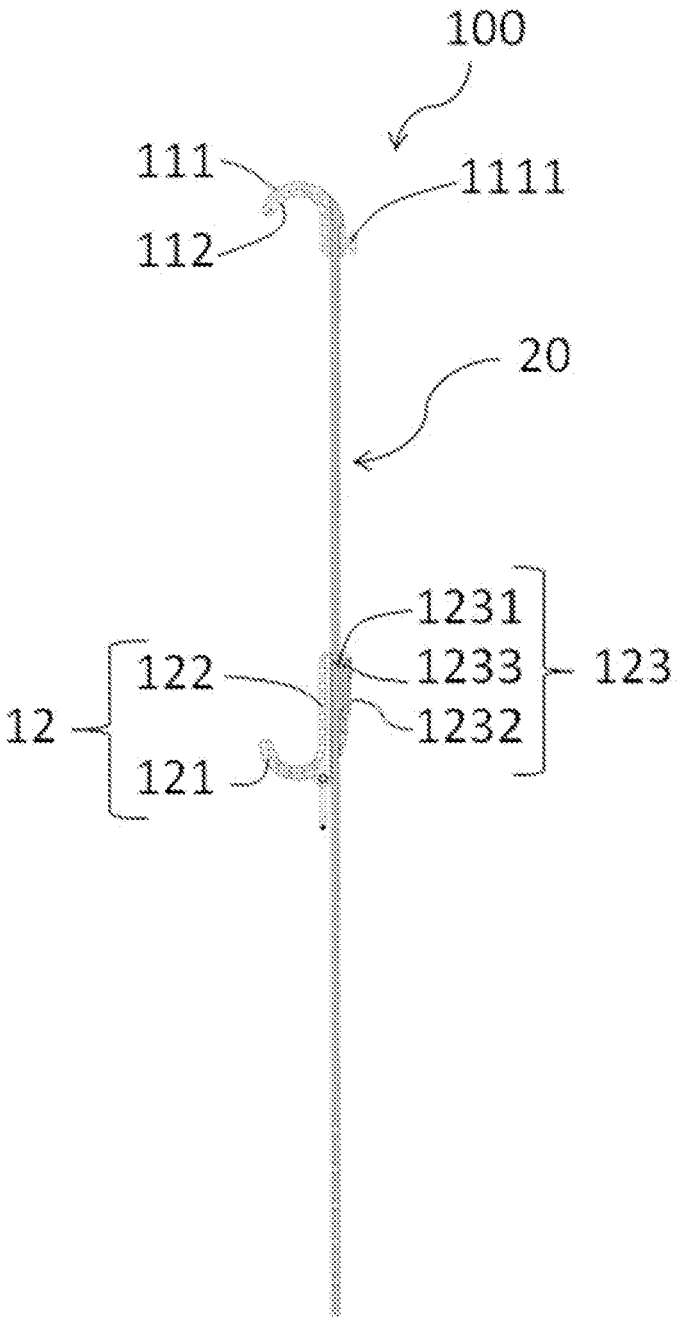
FIG. 4 is a sectional view of the electronic product fixator shown in FIG. 1.
Figure 5:
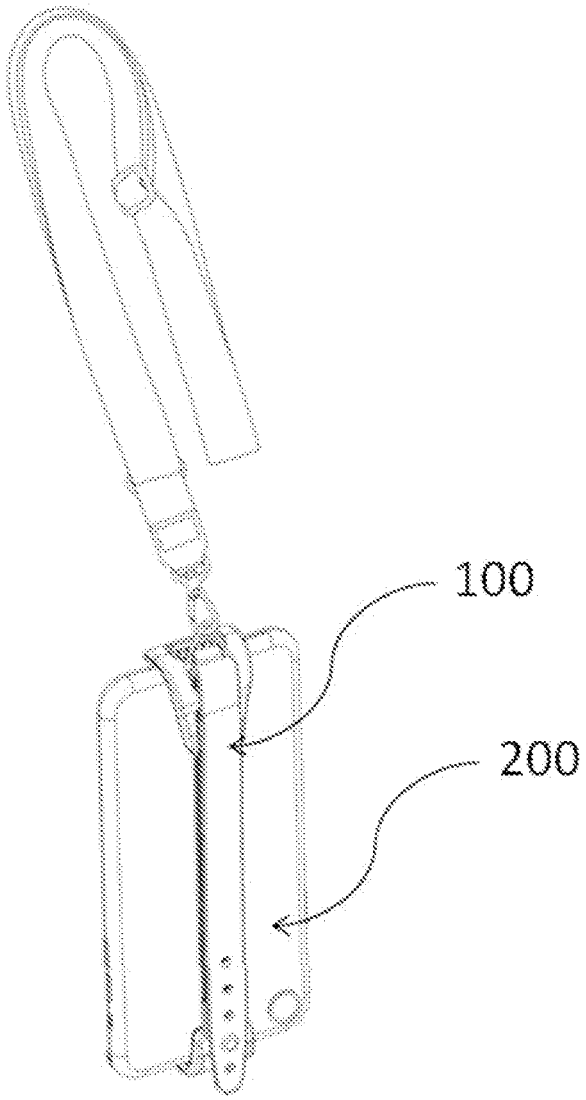
FIG. 5 is a reference diagram of a usage status of the electronic product fixator shown in FIG. 1.
Figure 6:
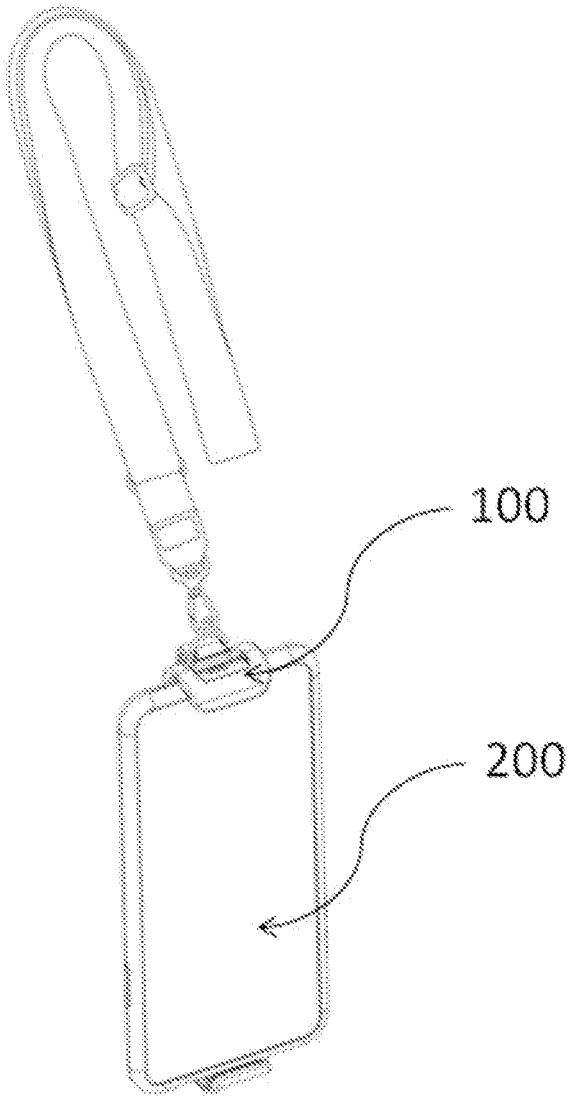
FIG. 6 is a reference diagram at another angle of a usage status of the electronic product fixator shown in FIG. 5.

Please refer to FIGS. 1-6 at the same time, wherein: FIG. 1 is a structural schematic diagram of an electronic product fixator in a retraction state according to the present disclosure; FIG. 2 is a structural schematic diagram of the electronic product fixator shown in FIG. 1 in an opening state; FIG. 3 is an exploded structural schematic diagram of the electronic product fixator shown in FIG. 1; FIG. 4 is a sectional view of the electronic product fixator shown in FIG. 1; FIG. 5 is a reference diagram of a usage status of the electronic product fixator shown in FIG. 1; and FIG. 6 is a reference diagram at another angle of a usage status of the electronic product fixator shown in FIG. 5.

An electronic product fixator 100 includes a clip assembly 10 and a locking strap 20 which fits in and is connected with the clip assembly 10, so that the two of them cooperate to fix an electronic device 200. The electronic device 200 may be a mobile phone and a tablet, etc.

The locking strap 20 has a strip-shaped structure as a whole and can bend to a certain extent, which includes a front section 21, a middle section 22, and an end section 23. Two ends of the middle section 23 are respectively connected with the front section 21 and the end section 23. The front section 21 is used to connect with the clip assembly 10. An inner surface of the middle section 22 has a toothed strap structure 221. The end section 23 has a second joint 231 which is a plurality of limiting holes 231 arranged linearly in this embodiment. The limiting holes 231 are used to connect with the corresponding structure on the clip assembly 10. It can be understood that the second joint 231 may also be fixed in other ways, such as bond fixing or clip fixing. In this embodiment, the locking strap 20 has an integral structure.

The clip assembly 10 is integrally connected with the locking strap 20. Specifically, the clip assembly 10 includes a first clip 11 and a second clip 12. The first clip 11 and the second clip 12 are arranged independently of each other and both connected with the locking strap 20.

The first clip 11 is used for fixing one end of an electronic product, which includes a first clip body 111 and a first slip stopper 112. The first slip stopper 112 is connected with the first clip body 111.

The first clip body 111 is connected with the locking strap 20 at one end thereof, with another end being a free end. The first clip body 111 has a cross section of a U-shaped structure, and a specific radian thereof can be determined as practically required. An outer surface of the first clip body 111 has a first joint 1111 which is disposed on the outer surface of the first clip body 111 and close to the end connected with the locking strap 20. The first joint 1111 is connected with the end section 23 of the locking strap 20. In this embodiment, the first joint 1111 is a limiting pin. Specifically, the limiting pin is arranged in a manner fitting in with a limiting hole 231 of the end section 23, so that the limiting pin 1111 passes through one of limiting holes 231 to fix the end section 23 of the locking strap 20 onto the limiting pin. In other embodiments, the first joint 1111 may have other structures and be connected with the second joint in a fitting manner, which is not limited by the present disclosure.

The first slip stopper 112 is arranged on the inner surface of the first clip body 111 and relatively fixed to and connected with the first clip body 111; and the first slip stopper 112 is made of an elastic material in order to better protect the electronic product while fixing the same, thus achieving a better fixation effect.

In this embodiment, the first slip stopper 112 can, be bonded to the first clip body 111. It can be understood that in other embodiments, the first slip stopper 112 may also be fixed to the first clip body 111 in other ways, which is not limited by the present disclosure.

The second clip 12 hoops the locking strap 20 and slidably reciprocates along the same. The second clip 12 is used for fixing the other end of the electronic product, which fits in with the first clip 11 to clamp and fix opposite ends of the electronic product. The second clip 12 has a structure similar to that of the first clip 11, and the second clip 12 includes a second clip body 121, a second slip stopper 122, a locking structure 123 and a connecting ring 124. The second slip stopper 122 is connected with an inner surface of the second clip body 121. The locking structure 123 is arranged on the backside of the second clip body 121. The connecting ring 124 is arranged on the second clip body 121.

The second clip body 121 has a structure integrally and substantially the same as that of the first clip body 111 in both structure and specification, with their cross sections both being U-shaped.

The first slip stopper 122 is arranged on the inner surface of the second clip body 121 and relatively fixed to and connected with the second clip body 121; and the second slip stopper 122 is also made of an elastic material, which will not be repeated herein.

The locking structure 123 is arranged at the top end of the second clip body 121. In this embodiment, the top end of the second clip body 121 has a limiting part 125 which is arranged in a way fitting in with the locking structure 123. In other words, the locking structure 123 may be just arranged into the limiting part 125, and one end of the locking structure 123 is hinged with the limiting part 125. The locking structure 123 includes a limiting part 1231, a pressing part 1232 and a joint 1233. Two ends of the joint 1233 are respectively connected with the limiting part 1231 and the pressing part 1232. Preferably, the locking structure 123 has an integrally formed structure.

The limiting part 1231 is arranged in a fitting way with the toothed strap structure 221. The limiting part 1231 can be engaged in the toothed strap structure 221 to fix the position of the second clip 12.

The joint 1233 is used for connecting with the second clip body 121. Specifically, the joint 1233 is hinged with the second clip body 121 in order to enable the locking structure 123 to move to a certain extent around the joint portion with the second clip body 121.

The pressing part 1232 may help a customer adjust the position of the second clip 12. Specifically, by pressing the pressing part 1232, the limiting part 1231 can be separated from the toothed strap structure 221, thereby facilitating displacement of the second clip 12.

The connecting ring 124 is hinged with the second clip body 121 and may move to a certain extent around the second clip body 121. The connecting ring 124 is used for connecting with a strap, so that the electronic product fixator 100 can be hung around the neck or held by hand.

The second clip 12A has a through hole 126 formed in the middle and arranged in a manner fitting in with the locking strap 20. That is, the locking strap 20 can pass through the through hole 126 of the second clip 12 to enable the second clip 12 to slidably reciprocate along the locking strap 20.

It can be understood that the through hole 126 penetrates through both the second clip body 121 and the second slip stopper 122. That is, the locking strap 20 can pass through the second clip body 121 and the second slip stopper 122 in turn.

In order to better understand the structure and usage of the electronic product fixator 100, the use flow of the electronic product fixator 100 will be described below.

First, an electronic device 200 in need of fixation is placed among parts of the clip assembly 10, and, by pressing the pressing part 1232 of the locking structure 123, the limiting part 1231 is separated from the toothed strap structure 221.

Next, the second clip 12 is moved and adjusted to an appropriate position. By releasing the pressing part 1232, the limiting part 1231 fits in and is connected with the toothed strap structure 221, thereby fixing the relative positions of the second clip 12 and the locking strap 20 so as to fix the electronic device.

Then, the end section 23 of the locking strap 20 is bent toward the limiting pin 112 of the first clip 11, and then the limiting hole 231 at a proper position is connected with the limiting pin 1111, thereby firmly fixing the electronic device onto the electronic product fixator 100.

The electronic product fixator 100 provided by the present disclosure is advantageous in terms of convenient operation, lightness, compactness, and steady fixation against detachment to prevent electronic devices from damages, by which a user can carry a electronic device by hand holding or wearing.

Those skilled in the art shall understand or realize the present disclosure through the specific embodiments provided in the present disclosure. Many modifications to these embodiments will be apparent to those skilled in the art, and the general principles defined herein may be implemented in other embodiments without departing from the spirit or scope of the present disclosure. Therefore, the present disclosure will not be limited to the embodiments shown herein, but fall within the widest scope consistent with the principles and novel features disclosed herein.

What is claimed is:

1. An electronic product fixator, comprising a clip assembly and a locking strap, wherein the clip assembly comprises a first clip connected with one end of the locking strap and a second clip hooping and reciprocating along the locking strap, a top surface of the first clip comprises a first joint, and the other end of the locking strap comprises a second joint wherein the locking strap is capable of bending to move the second joint towards the first joint to connect the first joint and the second joint together to prevent the second clip from moving along the locking strap away from the first clip so as to fix an electronic device to be fixed between the first and the second clips.

2. The electronic product fixator according to claim 1, wherein the first joint is a limiting pin, and the second joint is a limiting hole being capable of matching and connecting to the limiting pin.

3. The electronic product fixator according to claim 1, wherein the first clip comprises a first clip body and a first slip stopper which is arranged on an inner surface of the first clip body.

4. The electronic product fixator according to claim 1, wherein the second clip comprises a second clip body and a second slip stopper which is arranged on an inner surface of the second clip body.

5. The electronic product fixator according to claim 1, wherein the first clip and the second clip have U-shaped vertical sections.

6. The electronic product fixator according to claim 4, wherein the locking strap comprises a front section, a middle section and an end section, wherein two ends of the middle section are respectively connected with the front section and the end section, and an inner surface of the middle section has a toothed strap structure.

7. The electronic product fixator according to claim 6, wherein the second clip body comprises a locking structure which comprises a limiting part arranged in a way fitting in with the toothed strap structure.

8. The electronic product fixator according to claim 4, wherein the second clip body further comprises a connecting ring that can be connected with a strap.

* * * * *